US007121362B2

(12) United States Patent
Hsu et al.

(10) Patent No.: US 7,121,362 B2
(45) Date of Patent: Oct. 17, 2006

(54) ELECTRICAL HAND TOOL WITH A POSITION ADJUSTABLE BATTERY PACK

(75) Inventors: Chih-Hua Hsu, Taichung (TW); Chen-Chen Cheng, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 0 days.

(21) Appl. No.: 10/999,432

(22) Filed: Nov. 30, 2004

(65) Prior Publication Data

US 2006/0113100 A1 Jun. 1, 2006

(51) Int. Cl.
*E21B 4/04* (2006.01)
*E21B 3/00* (2006.01)

(52) U.S. Cl. ..... 173/217; 173/170; 310/50

(58) Field of Classification Search ..... 173/170, 173/216, 217, 221; 81/57.11; 310/47, 50
See application file for complete search history.

(56) References Cited

U.S. PATENT DOCUMENTS 4,759,240 A * 7/1988 Lin ..... 81/177.8
5,089,738 A * 2/1992 Bergqvist et al. ..... 310/50
5,372,420 A * 12/1994 Van Deursen et al. ..... 366/129
6,139,359 A * 10/2000 Fuhreck et al. ..... 439/500
6,364,033 B1 * 4/2002 Hung et al. ..... 173/217
6,467,556 B1 * 10/2002 Alsruhe ..... 173/217
6,729,415 B1 * 5/2004 Huang ..... 173/217

* cited by examiner

*Primary Examiner*—Rinaldi I. Rada
*Assistant Examiner*—Nathaniel Chukwurah
(74) *Attorney, Agent, or Firm*—Jackson Walker, LLP

(57) ABSTRACT

An electrical hand tool has a tool assembly, a battery pack and an adjusting device. The tool assembly has a body with an internal mechanism. The battery pack is adjustably connected to the body and is electrically connected to the internal mechanism. The adjusting device has an adjusting base, an adjusting post, a locking knob and a biasing member. The adjusting base is rotatably attached to the body and is attached to the battery pack in a non-rotatable manner. The adjusting post is mounted between the adjusting base and the body and has a positioning collar provided with multiple positioning notches. The locking knob is moveably attached to the adjusting base and has a locking stub held in one of the positioning notches. In such an arrangement, the battery pack that can be adjusted in position to make the hand tool convenient and versatile in use.

13 Claims, 8 Drawing Sheets

ELECTRICAL HAND TOOL WITH A POSITION ADJUSTABLE BATTERY PACK

BACKGROUND OF THE INVENTION

1. Field of the Invention

The present invention relates to an electrical hand tool, and more particularly to an electrical hand tool with an adjustable battery pack in position.

2. Description of Related Art

With reference to FIG. 8, a conventional electrical hand tool in accordance with the prior art substantially comprises a tool assembly (40) and a battery pack (50). The tool assembly (40) has a body with a handle (43), and a connecting portion (431) is formed on the bottom of the handle (43). The battery pack (50) is connected to the handle (43) and has a connecting post (51) inserted into the connecting portion (431) on the handle (43) to connect the battery pack (50) with the handle (43) together.

However, as the battery pack (50) of the conventional electrical hand tool is securely attached to the handle (43) at a fixed position and angle, to change or to adjust the position or angle of the battery pack (50) relative to the handle (43) is impossible. Therefore, the battery pack (50) extending toward the front of the tool assembly (40) inconveniently abuts against a protruding object on a working location, and this will limits the operation of the hand tool.

To overcome the shortcomings, the present invention tends to provide an electrical hand tool with an adjustable battery pack to mitigate or obviate the aforementioned problems.

SUMMARY OF THE INVENTION

The main objective of the invention is to provide an electrical hand tool having an adjustable battery pack that can be adjusted in position to make the hand tool convenient and versatile in use. The electrical hand tool has a tool assembly, a battery pack and an adjusting device. The tool assembly has a body with an internal mechanism mounted inside the body and is adapted for driving a tool to rotate. The battery pack is adjustably connected to the body of the tool assembly and is electrically connected to the internal mechanism to provide electrical power to the internal mechanism. The adjusting device is mounted between the body of the tool assembly and the battery pack to connect the battery pack to the body. The adjusting device has an adjusting base, an adjusting post, a locking knob and a biasing member. The adjusting base is rotatably attached to the body and is attached to the battery pack in a ?>non-rotatable manner. The adjusting post is mounted between the adjusting base and the body and has a central hole defined through the adjusting post and a positioning collar formed on and protruding from the bottom of the adjusting post. Multiple positioning holes are defined in the positioning collar to divide the positioning collar into multiple positioning tabs. The locking knob is moveably attached to the adjusting base, corresponds to the positioning collar on the adjusting post and has a locking stub held in one of the positioning holes in the positioning collar to engage with corresponding adjacent positioning tabs. The biasing member is mounted inside the adjusting base and abuts against the locking knob to keep the locking stub of the locking knob held inside a corresponding positioning hole.

Other objects, advantages and novel features of the invention will become more apparent from the following detailed description when taken in conjunction with the accompanying drawings.

DETAILED DESCRIPTION OF PREFERRED EMBODIMENT

Figure 1:
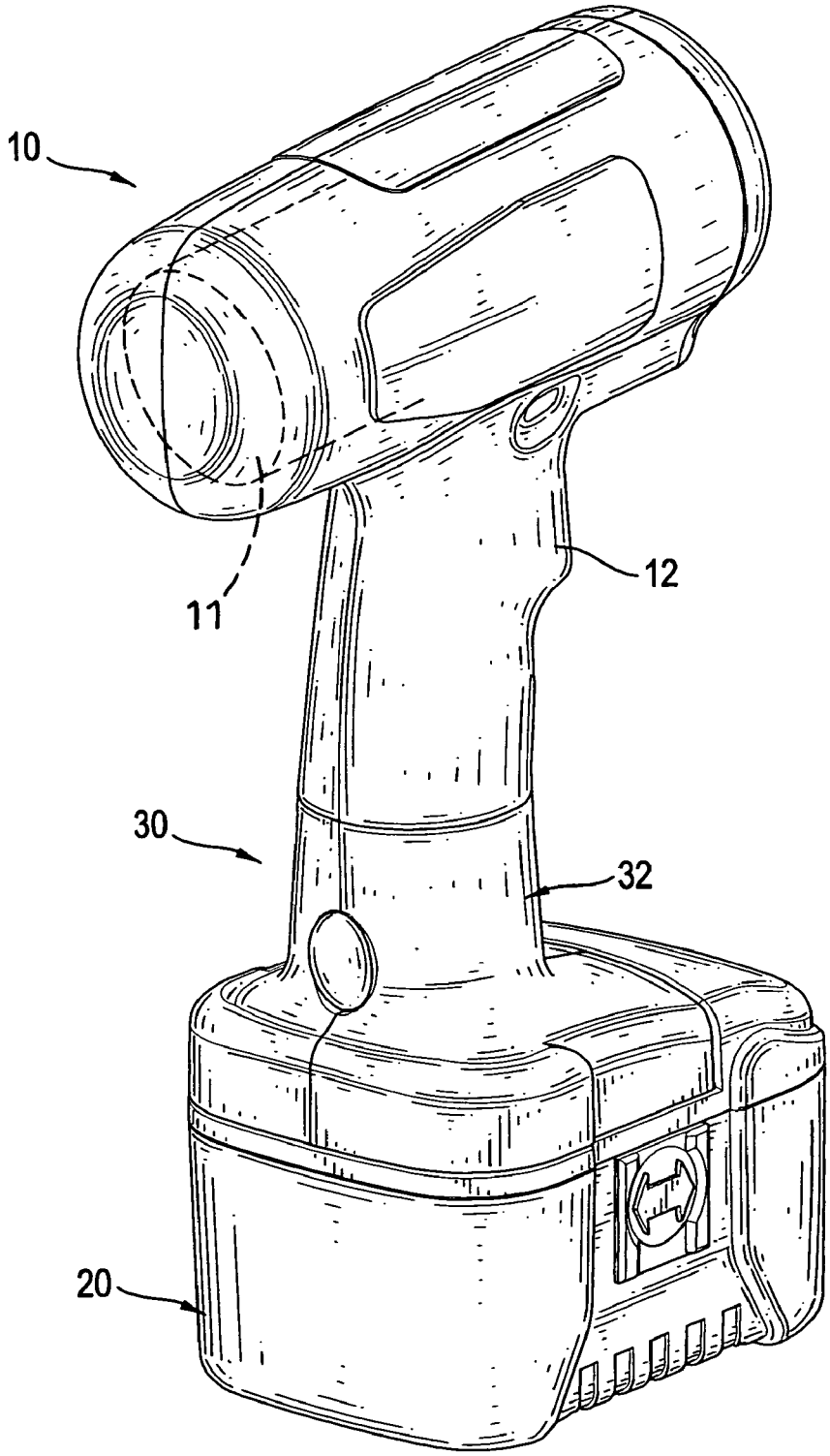
FIG. 1 is a perspective view of an electrical hand tool in accordance with the present invention.
Figure 2:
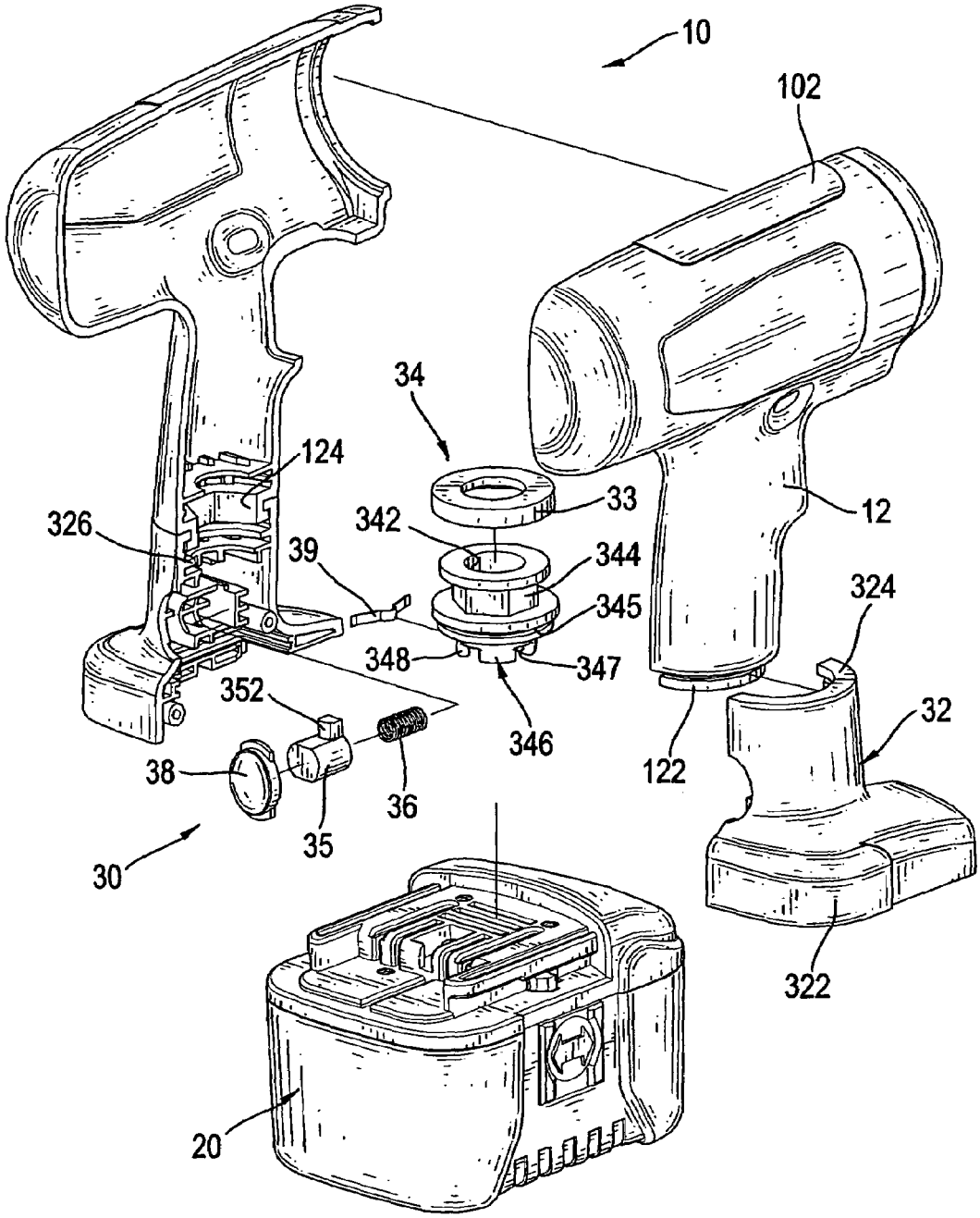
FIG. 2 is an exploded perspective view of the electrical hand tool in FIG. 1.
Figure 3:
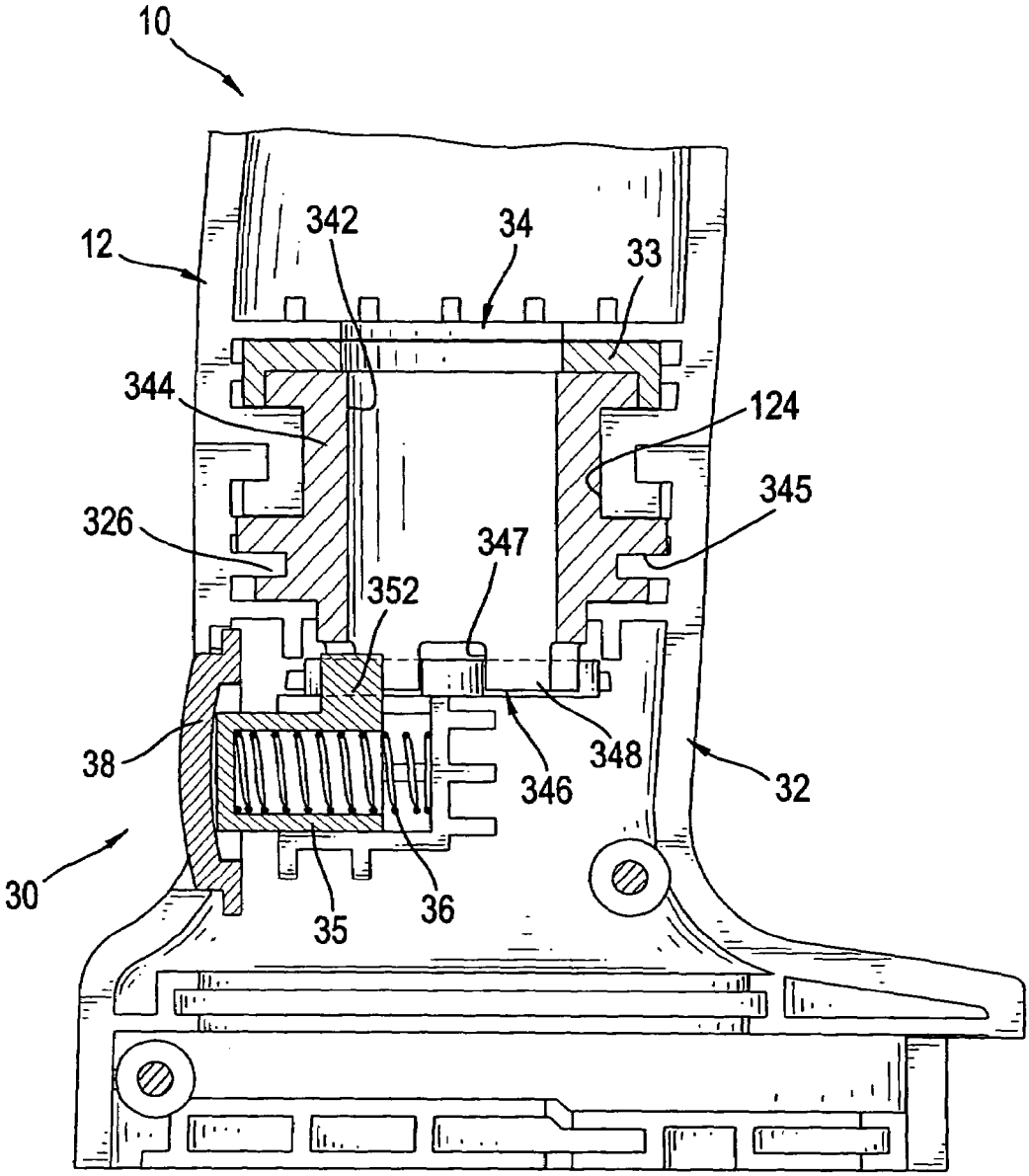
FIG. 3 is an enlarged side plan view in partial cross section of the electrical hand tool in FIG. 1.

With reference to FIGS. 1 to 3, an electrical hand tool in accordance with the present invention comprises a tool assembly (10), a battery pack (20) and an adjusting device (30). The tool assembly (10) has a body with an internal mechanism (11) mounted inside the body to drive a tool to rotate. The body is composed of two half shells (102) and forms a handle (12) for a user to grip the body. The internal mechanism (11) can be same as a conventional one, such that the detail description of the internal mechanism (11) is omitted and not further described.

The battery pack (20) is adjustably connected to the body of the tool assembly (10) and is electrically connected to the internal mechanism with wires to provide electrical power to the internal mechanism.

The adjusting device (30) is mounted between the body of the tool assembly (10) and the battery pack (20) to connect the battery pack (20) to the body and comprises an adjusting base (32), an adjusting post (34), a locking knob (35) and a biasing member (36). The adjusting base (32) is rotatably attached to the handle (12) of the body and is attached to the battery pack (20) in a non-rotatable manner. The adjusting base (32) comprises a housing composed of two half casings (322). To rotatably connect the adjusting base (32) with the handle (12) of the body, each half casing (322) has a semicircular flange (324) corresponding to the semicircular flange (324) on the other half casing (322). The handle (12) has a circular engaging portion (122) to mate with the flanges (324) on the half casings (322). With the engagement between the engaging portion (122) and the flanges (324), the adjusting base (32) is rotatably attached to the handle (12). In addition, a track device is mounted between the adjusting base (32) and the battery pack (20) to connect these two elements (20,32) together in a non-rotatable manner.

The adjusting post (34) is mounted between the adjusting base (32) and the handle (12) of the body. The adjusting post (34) is rotatably mounted inside the adjusting base (32) and is connected to the handle (12) of the body in a non-rotatable manner. To rotatably mount the adjusting post (34) inside the adjusting base (32), the adjusting post (34) has an annular groove (345) defined around the adjusting post (34), and each half casing (32) has a curved tab (326) to engage with the annular groove (345) in the adjusting post (34). With the engagement between the annular groove (345) and the curved tabs (326), the adjusting post (34) can rotate inside the adjusting base (32). In addition, the adjusting post (34) has a non-circular head (344) formed on the top of the adjusting post (34), and each half shell (102) of the body has a non-circular recess (124) to secure the non-circular head (344) on the adjusting post (34) in a non-rotating manner. Accordingly, the adjusting post (34) is connected to the handle (12) of the body in a non-rotatable manner with the engagement of the non-circular head (344) and the recesses (124).

The adjusting post (34) has a central hole (342) defined through the adjusting post (34) for the wires, that is those connecting between the battery pack (20) and the internal mechanism, to extend through the central hole (342). A positioning collar (346) is formed on and protrudes from the bottom of the adjusting post (34), and multiple positioning notches (347) are defined in the positioning collar (346) to divide the positioning collar (346) into multiple positioning tabs (348). In a preferred embodiment, four positioning notches (347) are defined in the positioning collar (346) to form four positioning tabs (348).

The locking knob (35) is moveably attached to the adjusting base (32) and corresponds to the positioning collar (346) on the adjusting post (34). The locking knob (35) has a locking stub (352) held in one of the positioning notches (347) in the positioning collar (346) to abut with corresponding adjacent positioning tabs (348). When the locking stub (352) is held inside one of the positioning notches (347), a blocking effect is provided to keep the adjusting post (34) from rotating relative to the adjusting base (32). In addition, a gasket (33) is mounted inside the adjusting base (32) and abuts against the top of the adjusting post (34).

The biasing member (36) is mounted inside the adjusting base (32) and abuts against the locking knob (35) to keep the locking stub (352) of the locking knob (35) held inside a corresponding positioning notch (347). In a preferred embodiment, the biasing member (36) is a spring.

In addition, a button (38) is moveably mounted inside and partly exposed from the adjusting base (32) and abuts against the locking knob (35). With the arrangement of the button (38), the user can conveniently push the locking knob (35) with the button (38).

In such an arrangement, the battery pack (20) is connected to the handle (12) of the body with the adjusting device (30). With the blocking effect provided by the locking stub (352), the adjusting post (35) will not rotate relative to the adjusting base (32) and the battery pack (20) will be position at a desired position and angle relative to the handle (12) of the body.

Figure 4:
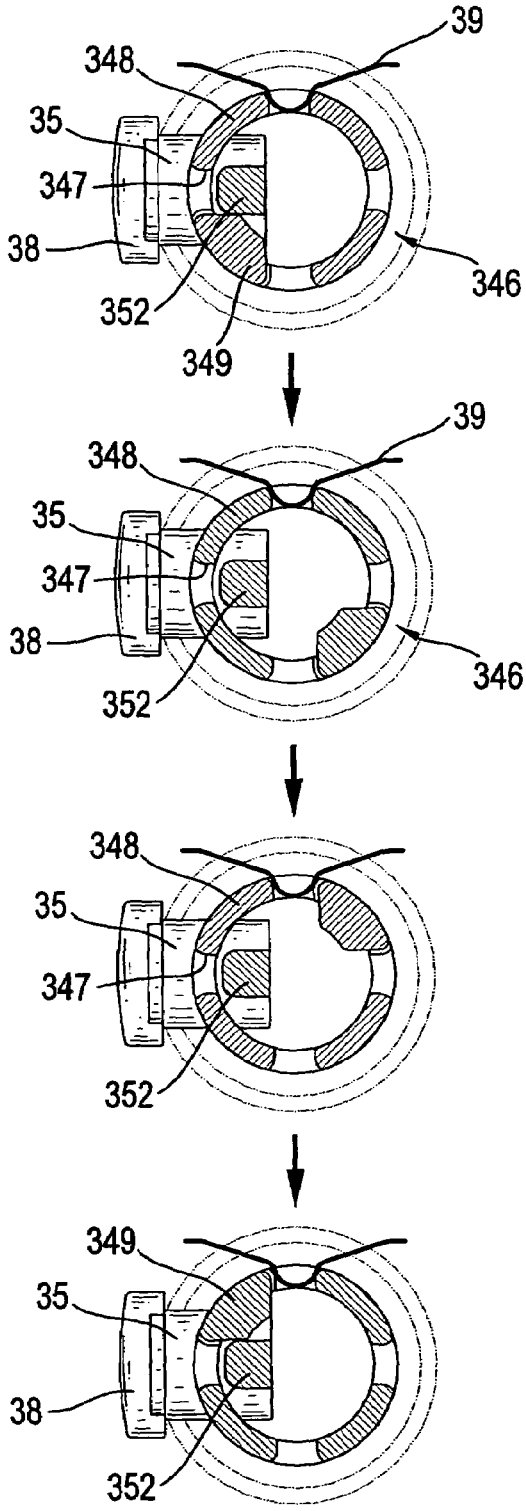
FIG. 4 is a series of operational top plan views in partial cross section of the adjusting device of the electrical hand tool in FIG. 1.
Figure 5:
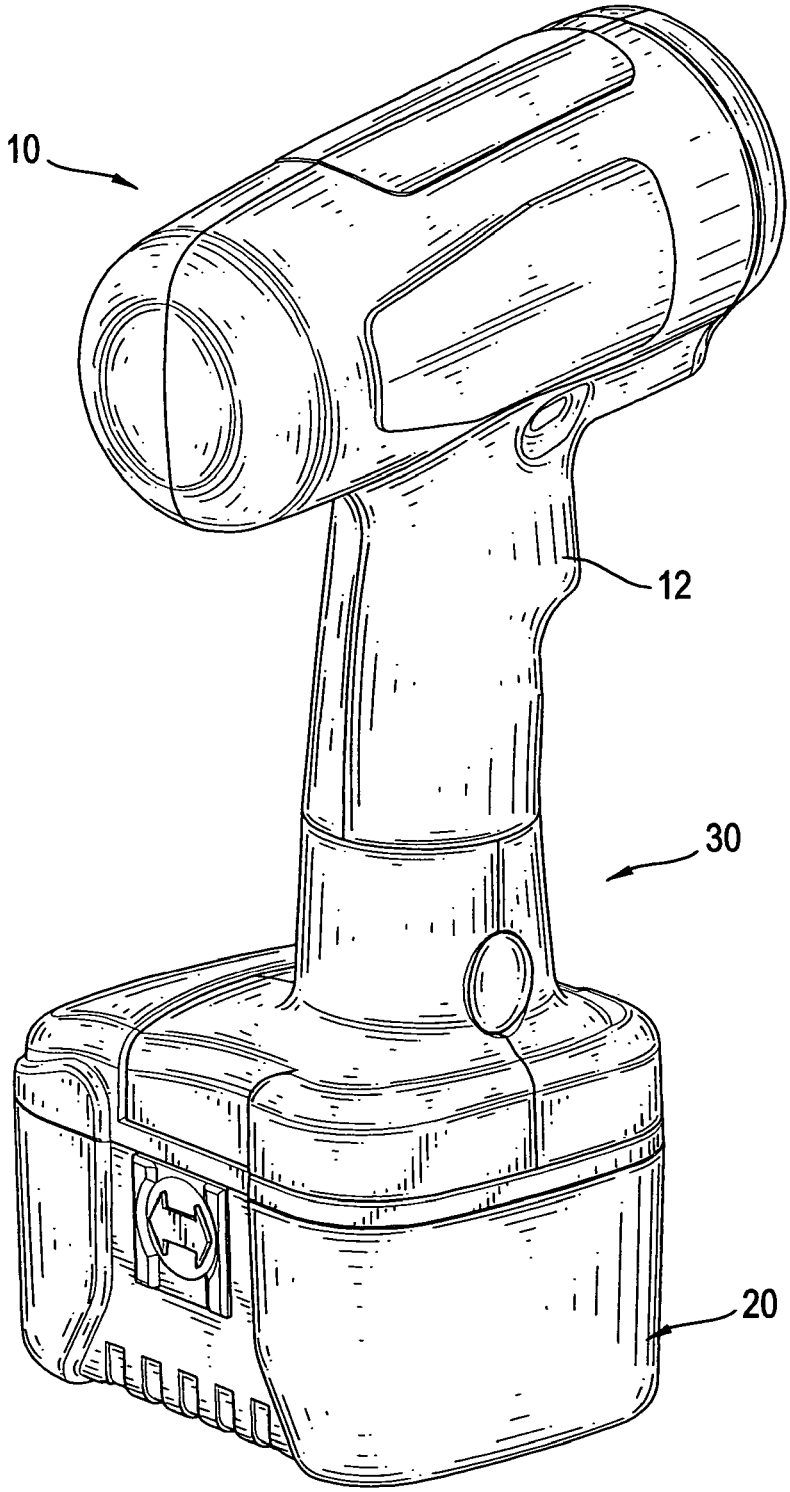
FIG. 5 is an operational perspective view of the electrical hand tool in FIG. 1 showing that the position of the battery pack is adjusted to 90° relative to the body of the tool assembly in FIG. 1.
Figure 6:
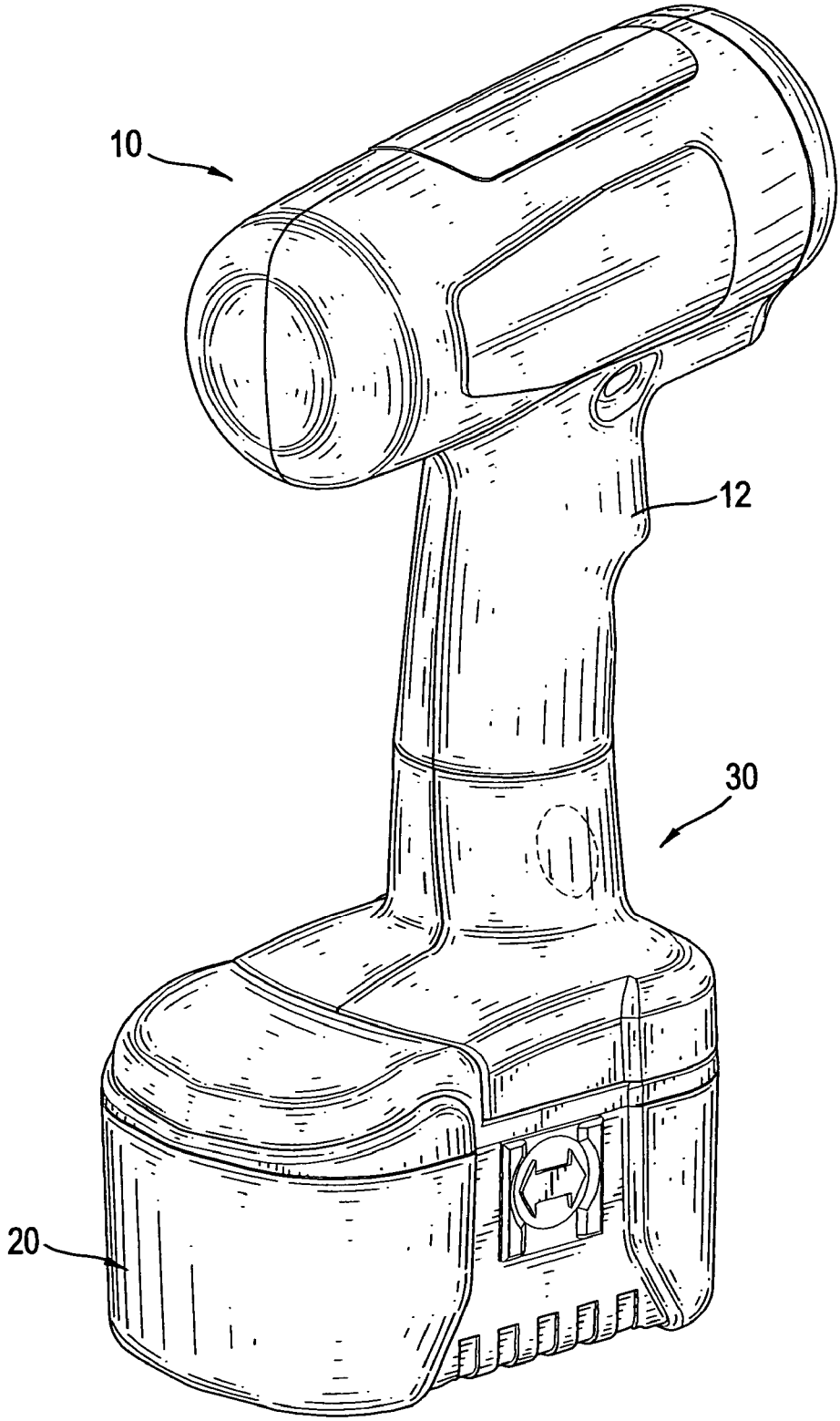
FIG. 6 is an operational perspective view of the electrical hand tool in FIG. 1 showing that the position of the battery pack is adjusted to 180° relative to the body of the tool assembly in FIG. 1.
Figure 7:
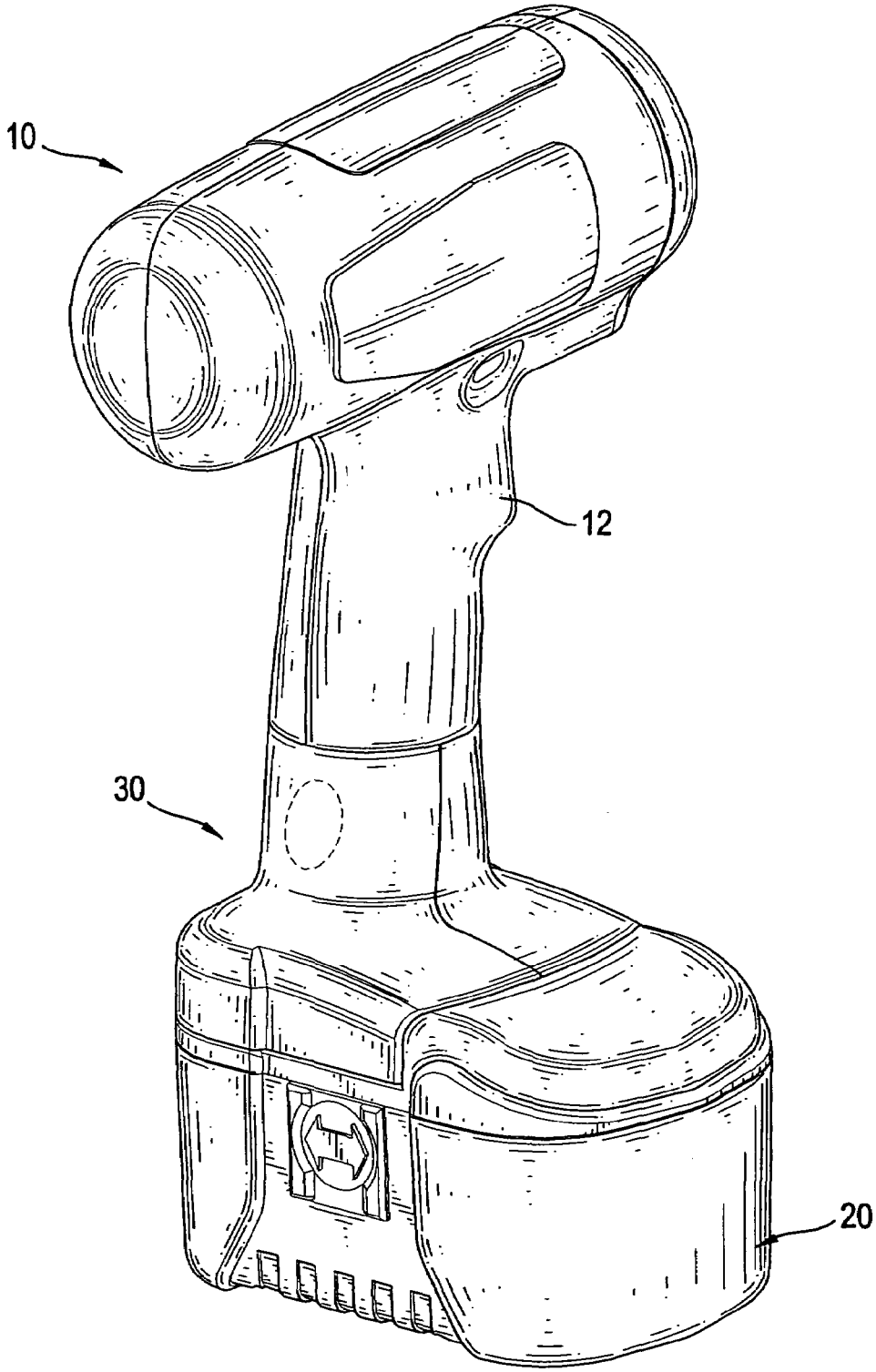
FIG. 7 is an operational perspective view of the electrical hand tool in FIG. 1 showing that the position of the battery pack is adjusted to 270° relative to the body of the tool assembly in FIG. 1.
Figure 8:
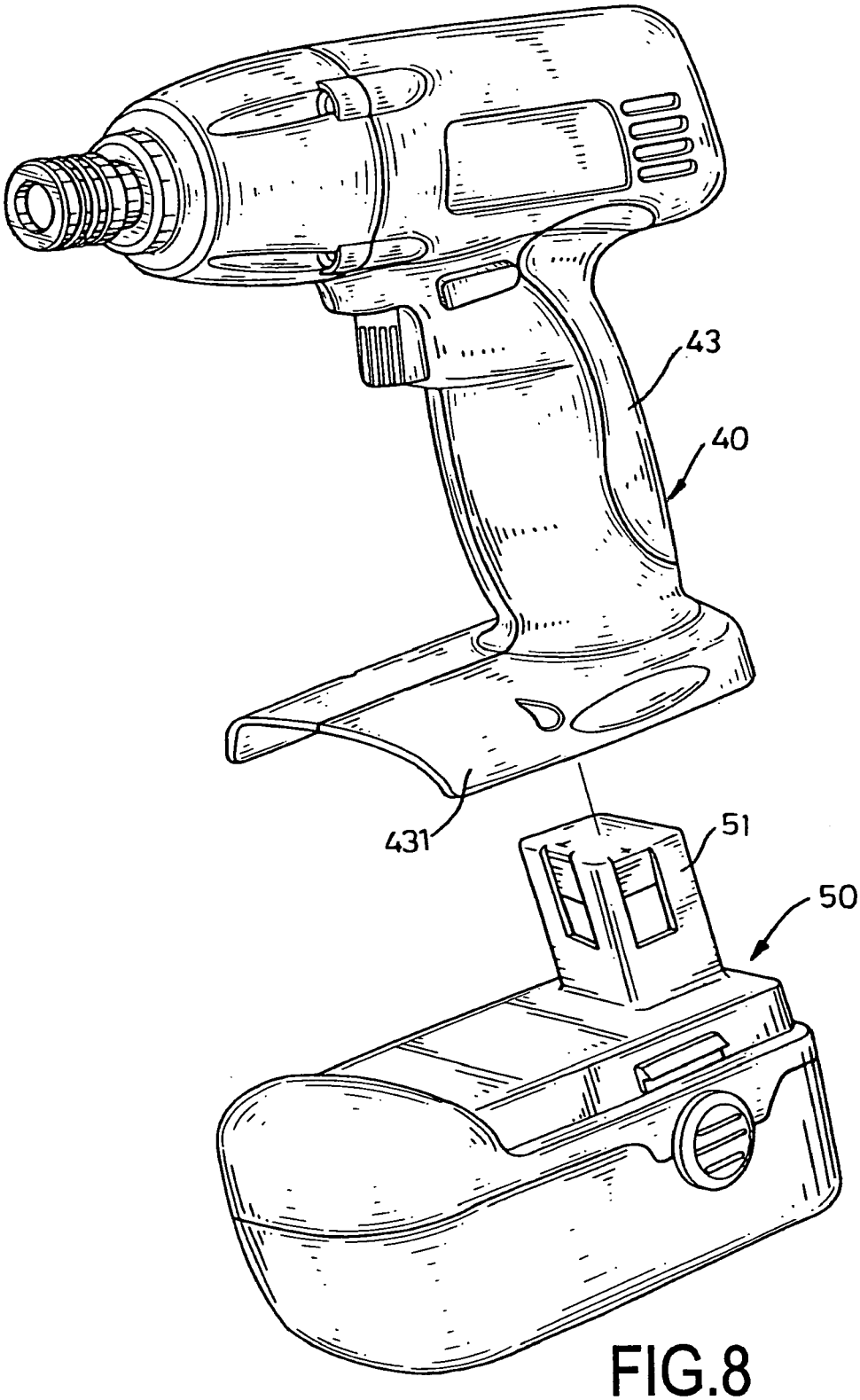
FIG.8 PRIOR ART
FIG. 8 is an exploded perspective view of a conventional electrical hand tool in accordance with the prior art.

With further reference to FIGS. 4, when the user pushes the button (38) to move the locking knob (35) relative to the adjusting base (32), the locking stub (352) on the locking knob (35) will leave the position where the locking stub (352) abuts with the corresponding positioning tabs (348) and moves inside the positioning collar (346). Consequently, the blocking effect provided by the locking knob (35) will be released, and the adjusting post (34) can be rotated relative to the adjusting base (32). Accordingly, the user can rotate the body with the adjusting post (34) relative to the adjusting base (32), such that the position and angle of the battery pack (20) relative to the body are changeable. When the body is rotated to a position where the locking stub (352) on the locking knob (35) aligns with a desired positioning notch (347) in the locking collar (346), the locking stub (352) will be urged into the aligning positioning notch (347) at the release of the button (38). Accordingly, the battery pack (20) will be positioned at a new position and angle relative to the body as shown in FIGS. 5 to 7. Thus, the user can adjust the relative position between the body and the battery pack (20) based on the needs of the user. Thus, the battery pack (20) can be kept from abutting against any object on a working place while the hand tool is in operation, and the hand tool with the adjusting battery pack (20) is convenient and versatile in use.

With reference to FIGS. 2 and 4, a resilient strip (39) is mounted inside the adjusting base (32) and has a protrusion engaging with one of the positioning notches (347) in the positioning collar (346). With the engagement between the resilient strip (39) and the corresponding positioning notch (347), an auxiliary positioning effect is provided. Furthermore, a noise will be generated when the protrusion of the resilient strip (39) jumps into the corresponding positioning hole (347), such that the user is notified that the battery pack (20) has been adjusted to a desired position and angle.

With reference to FIG. 4, one of the positioning tabs (348) on the positioning collar (346) has a block (349) formed on an inner surface of the positioning tab (348) and corresponding to and abutting against the locking stub (352) when the locking knob (35) is pushed. With the arrangement of the block (349), the adjusting post (34) can be kept from rotating more than 360 degrees with the abutment between the block (349) and the locking stub (352) on the locking knob (35). This can prevent the wires connected between the battery pack (20) and the internal mechanism from being damaged by excessive movement.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical hand tool comprising:

a tool assembly having a body with an internal mechanism mounted inside the body and adapted for driving a tool to rotate;

a battery pack adjustably connected to the body of the tool assembly and electrically connected to the internal mechanism to provide electrical power to the internal mechanism;

an adjusting device mounted between the body of the tool assembly and the battery pack to connect the battery pack to the body and comprising an adjusting base rotatably attached to the body and attached to the battery pack in a non-rotatable manner; and an adjusting post mounted between the adjusting base and the body and having a top;

a bottom;

a central hole defined through the adjusting post;

a positioning collar formed on and protruding from the bottom; and multiple positioning notches defined in the positioning collar to divide the positioning collar into multiple positioning tabs;

a locking knob moveably attached to the adjusting base, corresponding to the positioning collar on the adjusting post and having a locking stub held in one of the positioning notches in the positioning collar to abut with corresponding adjacent positioning tabs; and a biasing member mounted inside the adjusting base and abutting against the locking knob to keep the locking stub of the locking knob being held inside a corresponding positioning notice;

wherein one of the positioning tabs on the positioning collar has a block formed on an inner surface of the positioning tab and corresponding to and abutting against the locking stub when the locking knob is pushed.

2. The electrical hand tool as claimed in claim 1, wherein the adjusting base comprises a housing composed of two half casings;

each half casing has a semicircular flange corresponding to the semicircular flange on the other half casing; and the body has a circular engaging portion to engage with the flanges on the half casings.

3. The electrical hand tool as claimed in claim 2, wherein the adjusting post has an annular groove defined around the adjusting post; and each half casing has a curved tab to engage with the annular groove in the adjusting post.

4. The electrical hand tool as claimed in claim 3, wherein the body of the tool assembly is composed of two half shells and forming a handle for the adjusting device attached to the handle;

each half shell has a non-circular recess; and a non-circular head formed on the top of the adjusting post and held inside the non-circular recesses in the half shells of the body to connect the adjusting post to the handle of the body in a non-rotatable manner.

5. The electrical hand tool as claimed in claim 4, wherein the positioning collar has four of the positioning notches to form four of the positioning tabs on the positioning collar.

6. The electrical hand tool as claimed in claim 5 further comprising a button abutting against the locking knob and moveably mounted inside and protruded from the adjusting base.

7. The electrical hand tool as claimed in claim 6 further comprising a resilient strap mounted inside the adjusting base and having a protrusion engaging with one of the positioning notches in the positioning collar.

8. The electrical hand tool as claimed in claim 1, wherein the adjusting post has an annular groove defined around the adjusting post; and each half casing has a curved tab to engage with the annular groove in the adjusting post.

9. The electrical hand tool as claimed in claim 1, wherein the body of the tool assembly is composed of two half shells and forming a handle for the adjusting device attached to the handle;

each half shell has a non-circular recess; and a non-circular head formed on the top of the adjusting post and held inside the non-circular recesses in the half shells of the body to connect the adjusting post to the handle of the body in a non-rotatable manner.

10. The electrical hand tool as claimed in claim 1, wherein the positioning collar has four of the positioning notches to form four of the positioning tabs on the positioning collar.

11. The electrical hand tool as claimed in claim 1 further comprising a button abutting against the locking knob and moveably mounted inside and protruded from the adjusting base.

12. The electrical hand tool as claimed in claim 1 further comprising a resilient strap mounted inside the adjusting base and having a protrusion engaging with one of the positioning notches in the positioning collar.

13. The electrical hand tool as claimed in claim 1 further comprising a gasket mounted inside the adjusting base and abutting against the top of the adjusting post.

* * * * *